United States Patent [19]

Salton

[11] Patent Number: 4,645,907

[45] Date of Patent: Feb. 24, 1987

[54] ELECTRIC HOT WATER HEATER

[76] Inventor: Lewis L. Salton, 1365 York Ave., New York, N.Y. 10021

[21] Appl. No.: 754,461

[22] Filed: Jul. 12, 1985

[51] Int. Cl.[4] ..... H05B 3/02

[52] U.S. Cl. ..... 219/309; 219/321

[58] Field of Search ..... 219/306–309, 219/298, 299, 320, 321, 331

[56] References Cited

U.S. PATENT DOCUMENTS 2,836,699 7/1956 Mullin ..... 219/309 X 3,261,963 12/1963 Weinstein ..... 219/309

*Primary Examiner*—L. T. Hix

*Assistant Examiner*—Douglas S. Lee

*Attorney, Agent, or Firm*—Edward D. O'Brian

[57] ABSTRACT

A desirable electric water heater can be constructed by providing a housing containing three separate heating elements. These heating elements are connected in series with separate switches which are ganged together so as to be closed when there is a pressure drop in the housing and so as to be opened when the pressure in the housing increases. The heating elements and their associated switches are in parallel across a power supply line.

4 Claims, 1 Drawing Figure

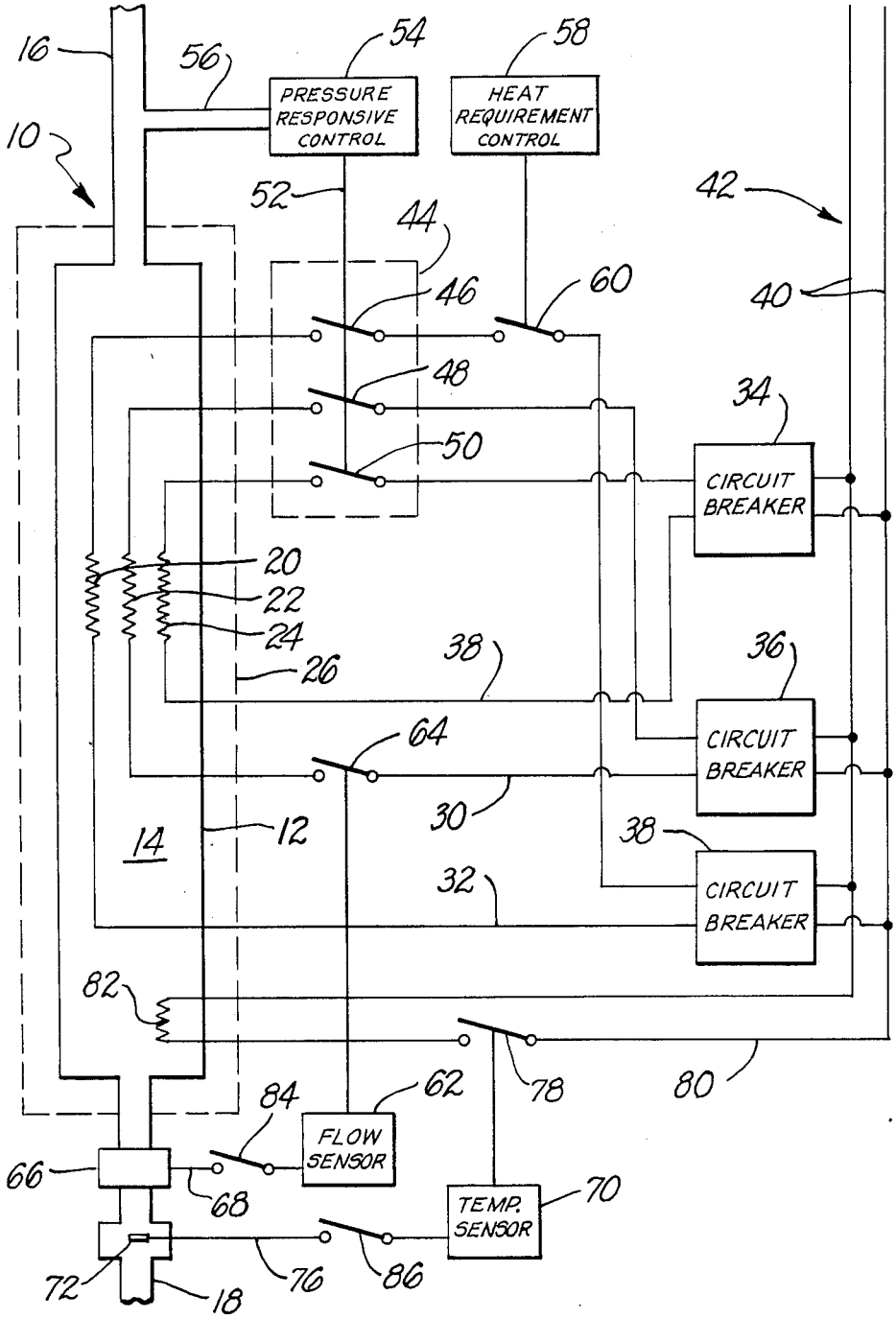
16
56
54
58
PRESSURE RESPONSIVE CONTROL
HEAT REQUIREMENT CONTROL
10
52
42
44
46
60
40
48
34
50
CIRCUIT BREAKER
20
22
24
26
38
36
64
CIRCUIT BREAKER
30
14
12
38
32
CIRCUIT BREAKER
82
78
80
84
62
FLOW SENSOR
66
68
TEMP. SENSOR
70
72
18
76
86

ELECTRIC HOT WATER HEATER

BACKGROUND OF THE INVENTION

The invention set forth in this specification pertains to new and improved electric water heaters. More specifically, it pertains to heaters of the type which are normally installed immediately adjacent to a specific locale where hot water is utilized so that water can be heated as it is needed and used. Heaters of this type are considered desirable because normally there is no need to use them in conjunction with storage tanks which hold a reserve of hot water so that such hot water is available whenever it is needed.

Heaters of the type to which this invention pertains have been more commonly utilized in Europe than in North America. It is considered that the reasons for this are primarily economic and relate to the differences in the standard AC voltages employed in these two regions. It will, of course, be recognized that the greater the voltage the lower the amount of current required in order to heat a specific quantity of water to a specific temperature. As a consequence of this the amount of current required to supply a specific quantity of hot water in Europe will normally be less than the amount of current required to supply the same quantity of hot water in North America where the standard voltages are lower than in Europe.

In general, the greater the amount of current carried in an electric line the more expensive the electrical apparatus required to carry or otherwise utilize such current. Hence, in Europe the connecting lines and circuit breakers used in connection with electric hot water heaters have tended to be less expensive than the corresponding parts required in connection with such heaters in North America. Various expedients have, of course, been attempted in efforts to reduce the costs of the circuit breakers or switches used in electric water heaters intended for sale in North America. It is considered that an understanding of the present invention does not require a detailed discussion or review of such prior expedients. It is considered adequate to note that in spite of such efforts it is believed that there is a need for improvement in this field.

SUMMARY OF THE INVENTION

A broad objective of the present invention is to provide new and improved electric water heaters. More specifically, the invention is intended to provide electric water heaters which may be relatively easily constructed at a comparatively nominal cost and which are capable of being operated effectively for prolonged periods with minimal maintenance. The invention is further intended to provide electric water heaters which are especially desirable in that they may include structures enabling them to be operated to provide hot water at different temperatures.

In accordance with this invention the principle of these objectives are achieved by providing an electric hot water heater having a housing provided with an inlet and an outlet, and electric resistance means located within said housing between said inlet and said outlet so that water flowing through said housing will flow past said resistance means, switch means for controlling the flow of current to said resistance means and line means for connecting said switch means and said resistance means to so that said switch means may be used to regulate the flow of current through said resistance means in which the improvement comprises: said resistance means comprises a plurality of separate resistance elements, said switch means comprises a plurality of separate switches, each of said switches corresponding to one of said resistance elements, pressure responsive means for operating all of said switches so as to concurrently close all of said switches upon a decrease in the pressure within said housing past a predetermined value and so as to concurrently open all of said switches upon an increase in pressure within said housing past said predetermined value, a plurality of separate circuit breaker means, each of said circuit breaker means corresponding to one of said switch means and one of said resistance means, said line means connecting each of said switch means and it corresponding resistance means in series across the breaker means corresponding to them, and a separate supply circuit means for supplying power to each said breaker means.

An electric water heater in accordance with this invention preferably includes an auxiliary switch means for controlling the amount of power supplied to the resistance means in accordance with the water temperature desired.

BRIEF DESCRIPTION OF THE DRAWING

Because of the nature of this invention it is best more fully explained with reference to the accompanying drawing in which:

the FIGURE diagrammatically indicates the construction of a presently preferred embodiment of a water heater in accordance with this invention.

In the drawing the construction of a water heater in accordance with this invention is indicated diagrammatically because the actual physical structure of such a water heater may be varied to a significant degree in accordance with routine engineering skill in the field of the design of electric water heaters. Because of this any water heater utilizing the operative concepts or principles of the invention as are set forth and defined in the dependent claims may be constructed in any of a variety of different manners.

DETAILED DESCRIPTION

In the drawing there is shown a water heater 10 in accordance with this invention which includes a housing 12 having an enlarged internal cavity 14. This housing 12 includes an inlet 16 and an outlet 18 so that it may be connected into a conventional water line (not shown). The cavity 14 is preferably shaped so that any flow from the inlet 16 to the outlet 18 will pass three different resistance heating elements 20, 22, and 24. These resistance elements 20, 22, and 24 may be mounted or supported within the cavity 14 in any convenient conventional manner. If desired, an insulating cover 26 may be located generally around the housing 12 for the obvious purpose of conserving heat.

In the heater 10 the resistance elements 20, 22 and 24 are connected in lines 28, 30 and 32, respectively. These lines 28, 30 and 32 are, in turn, attached to conventional, protective circuit breakers 34, 36 and 38 as illustrated. These breakers 34, 36 and 38 are supplied with power through three separate supply circuits 40 which will be normally used to each supply a 220–240 volt AC current through conductors 42 from a conventional distribution source (not shown). Because the breakers 34, 36 and 38, in effect, act as switches which automatically open in response to a current overload, it may be considered that they are switch means connected in series with the resistance elements 20, 22 and 24. Because these breakers 34, 36 and 38 are supplied through separate conventional circuits 40 they need not be as large and as expensive as would be required if all heating current passed through a single breaker.

The lines 28, 30, and 32 all are connected to what may be regarded as a composite, conventional, known switch 44 consisting of three separate switches 46, 48, and 50 ganged together through the use of a conventional mechanical connection 52. With this construction the switch 46 is in series with the element 20, the switch 48 is in series with the element 22, and the switch 50 is in series with the element 24. Because of the use of separate resistance elements it is possible to avoid the use of switches and breakers having a high current carrying capacity. This is quite important from an economic standpoint.

The connection 52 is designed to be operated through the use of a conventional pressure responsive control 54 which is connected into the interior of the housing 12 through a small fluid line 56 so as to be responsive to a pressure change within the interior of this housing 12. This pressure responsive control 54 is used so as to concurrently close the switches 46 when the pressure drops within the housing 12 past a predetermined value as the result of the commencement of flow through it and to concurrently open the switches 46, 48, and 50 when there is a pressure rise within the housing 12 past this predetermined value as a result of the flow ceasing.

The heater 10 also includes a heat requirement control 58 of conventional construction which is mechanically connected to another switch 60 in the line 32 associated with the first resistance element 20. In an appropriate circumstance this control 58 may be a simple toggle mechanism for opening or closing the switch 60. Normally, however, it will consist of a relay connected to a remotely positioned control (not shown) and to the switch 60 for opening or closing the switch 60 in accordance with the operation of such a remotely located control. Such a remotely located control can be a switch or the like which is automatically operated whenever an appliance which uses hot water is operated.

The heater 10 further includes a conventional flow responsive control 62 which is mechanically connected to a further switch 64 in the line 32 in series with the resistance element 20. Preferably it is connected to a conventional flow measurement device 66 in the outlet 18 through the use of an electric line 68.

Further, the heater 10 preferably includes a conventional temperature sensing control 70 connected to a temperature sensing device 72 of known construction located in the outlet 18 through the use of a further electric line 76. This control 72 is mechanically connected to a further switch 78 in a further separate supply current or line 80 so as to be in series with another resistance element 82 across the conductors 40. This element 82 is supported in the cavity 14 in a conventional manner.

The operation of the heater 10 is essentially as one might expect from the consideration of the various parts within it. When the heat requirement control 58, the flow responsive control 62, and the temperature sensitive control 72 are not used with the heater 10, the mere opening of a valve (not shown) in the line (not shown) in which this heater 10 is connected will cause a pressure drop past a predetermined value resulting in the pressure responsive control 54 closing the switches 46, 48, and 50 within the composite switch 44. Power will then be supplied until the flow is stopped and the control 54 operates as a result of the increase in pressure past this valve so tht the switches 46, 48, and 50 and the composite switch 44 are open.

When, as preferred, the heat requirement control 58 used with the invention, the switch 60 will normally be maintained either open or closed in accordance with the water temperature needed at a specific time. It is important to note that the operation of an appliance requiring hotter than normal water can be used to actuate this switch 60. Obviously when the switch 60 is open the actuation of the composite switch 44 will not result in power being supplied to the resistance element 20 whereas power will be supplied when the switch 60 is closed. When power is increased in this manner the temperature of the water passing through the heater 10 will be increased.

The heater 10 is also preferably used with the flow responsive control 62 which operates in substantially the same manner. Normally the switch 64 will be maintained open. When, however, there is a predetermined flow through the heater 10 such that the elements 20 and 24 will not maintain a desired water temperature the volume of water moving through the housing 12 exceeding a predetermined value, so as to close the switch 64. Thereafter, the resistance element 22 will be operated until such time as the flow drops past the predetermined value necessary to actuate the control 62. At this point it will operate so as to open the switch 64. It is also possible to achieve substantially the same results as is achieved with the control 62 by substituting a conventional temperature measuring device (not shown) for the device 66 and utilizing a conventional temperature sensing control (not shown) for the control 62. It is considered, however, that it is preferable to utilize the flow responsive control 62 and the measurement device 66 as previously described.

When, as preferred the temperature sensing control 70 is used with resistance element 82, the sensing device 72 will be responsive to a decrease in temperature in the water in the outlet 18 past a predetermined value. At this point the control 70 will close the switch 78 so as to cause the other element 82 to operate until such time as a predetermined cutoff temperature has been reached. This, of course, will be detected by the device 72 and the control 70 so as to open the switch 78. Preferably, this device 72 should be located within the outlet 18 so that the control 70 will operate to maintain a desired temperature immediately adjacent to this outlet 18 to minimize the possibility of a user receiving an initial surge of cold or relatively cool water.

It is obvious that quite a number of changes may be made in the structure described. If desired, the resistance values of the resistance elements 20, 22, and 24 may differ. This may be desirable in varying the amount of temperature change resulting from the operation of the heat requirement control 58 or the flow responsive control 62. In order to simplify the illustration of the circuit shown in the drawing and in the description in this specification all references to grounding of various components used has been omitted. It is considered obvious that grounds will normally be provided in the heater 10 in accordance with routine practice.

The concepts of the present invention can also be utilized to provide more resistance elements than are shown which are cut into or out of a circuit at various different flow rates corresponding to various different outlet water temperatures. It is possible to provide switches 84 and 86 as indicated so as to cutoff the flow responsive control 62 and the temperature sensitive control 72 if, for any reason, they are not desired or needed. All such changes are considered to be within routine engineering skill in the field of the invention.

I claim:

1. An electric hot water heater having a housing provided with an inlet and an outlet, electric resistance means located within said housing between said inlet and said outlet so that water flowing through said housing will flow past said resistance means, switch means for controlling the flow of current to said resistance means and line means for connecting said switch means and said resistance means means so that said switch means may be used to regulate the flow of current through said resistance means in which the improvement comprises:

said resistance means comprises a plurality of separate resistance elements, said switch means comprises a plurality of separate switches, each of said switches corresponding to one of said resistance elements, pressure responsive means for operating all of said switches so as to concurrently close all of said switches upon a decrease in the pressure within said housing past a predetermined value and so as to concurrently open all of said switches upon a increase in pressure within said housing past said predetermined value, a plurality of separate circuit breaker means, each of said circuit breaker means corresponding to one of said switch means and one of said resistance means, said line means connecting each of said switch means and it corresponding resistance means in series across the breaker means corresponding to them, and a separate supply circuit means for supplying power to each said breaker means.

2. An electric hot water heater as claimed in claim 1 including:

heat requirement control means and an associated switch, said heat control requirement control means being located in one of said lines, said heat requirement control means being capable of being used to control the flow of current through one of said lines.

3. An electric water heater as claimed in claim 1 including;

temperature control means including a temperature sensor means located within said housing and a further switch which is opened by said temperature control means above the predetermined temperature and closed by said temperature control means below the predetermined temperature, and a further resistance element, and a further line connecting said further resistance element and said further switch across said conductors.

4. An electric water heater as claimed in claim 1 including:

heat requirement control means and an associated switch, said heat control requirement being located in one of said lines, said heat requirement control means being capable of being used to control the flow of current through one of said lines, temperature control means including a temperature sensor means located within said housing and a further switch which is opened by said temperature control means above the predetermined temperature and closed by said temperature control means below the predetermined temperature, and a further resistance element, and a further line connecting said further resistance element and said further switch across said conductors.

* * * * *